United States Patent [19]

Shirk

[11] Patent Number: 4,967,845

[45] Date of Patent: Nov. 6, 1990

[54] LOCK OPEN MECHANISM FOR DOWNHOLE SAFETY VALVE

[75] Inventor: Steven H. Shirk, Broken Arrow, Okla.

[73] Assignee: Baker Hughes Incorporated, Houston, Tex.

[21] Appl. No.: 442,709

[22] Filed: Nov. 28, 1989

[51] Int. Cl.[5] ..... E21B 34/06

[52] U.S. Cl. ..... 166/386; 166/323; 251/58; 251/83

[58] Field of Search ..... 166/386, 323, 325, 334; 251/58, 83

[56] References Cited

U.S. PATENT DOCUMENTS

| | | | |
|---|---|---|---|
| 3,786,866 | 1/1974 | Tausch et al. | 166/323 X |
| 4,344,602 | 8/1982 | Arendt | 251/58 |
| 4,577,694 | 3/1986 | Brakhase, Jr. | 166/382 |
| 4,624,315 | 11/1986 | Dickson et al. | 166/323 |
| 4,796,708 | 1/1989 | Lembcke | 166/386 |

*Primary Examiner*—William P. Neuder

*Attorney, Agent, or Firm*—Hubbard, Thurman, Turner, Tucker

[57] ABSTRACT

A lock open mechanism for downhole safety valve of the type having a valve head movable downwardly from a closed to an open position relative to the bore of a well conduit. The housing of the safety valve is provided with a first downwardly facing locking shoulder above the valve head. The upper portion of the safety valve housing is provided with a no-go shoulder and above that a second downwardly facing latching shoulder. A mandrel has a tubular locking body shearably secured to its lower end which locking body is abutable with the valve head. The valve head is displaced downwardly by incremental jar produced downward movements of the mandrel until a locking collet carried on the locking body engages the first downwardly facing locking shoulder. The second downwardly facing latching shoulder absorbs upward forces exerted on the mandrel and the locking assemblage through engagement by a latching collet mounted on an intermediate housing which is carried into the well by a shearable connection which is released when the mandrel reaches its run-in position. After the locking collet is engaged, the latching collet heads are freed for disengagement from the valve housing, permitting the mandrel and the intermediate housing assemblage to be retrieved from the well.

15 Claims, 6 Drawing Sheets

LOCK OPEN MECHANISM FOR DOWNHOLE SAFETY VALVE

BACKGROUND OF THE INVENTION

1. Field of the Invention

The invention relates to a lock open mechanism for a downhole safety valve, and particularly to a safety valve having an axially shiftable valve head for closing the bore of the well conduit.

2. Summary of the Prior Art

Lock open devices for safety valves have been known in the prior art for practically as long as downhole safety valves. The need for a lock open device is well known. In the event of any failure of the downhole safety valve, a lock open device will permit the bore of the well conduit in which the safety valve is mounted to be open, permitting the passage of well tools downwardly through the defective safety valve. In the event that there are an insufficient number of operative safety valves in the well conduit, the function of the defective safety valve can be performed by an in-tubing safety valve which is lowered through the locked open safety valve to sealingly engage the bore of the defective safety valve and provide a substitute functioning valve at that position in the well conduit. A typical lock open mechanism for a safety valve, and a replacement in-tubing safety valve, are shown in U.S. Pat. No. 3,696,868.

The great majority of safety valves employ either a flapper or a rotatable ball as the valve head which is shiftable between a closed to an open position by a lock open mechanism. Typically, such safety valves are normally operated by an actuating sleeve and the lock open mechanism functions to depress the actuating sleeve to its valve opening position and latch the actuating sleeve in such position.

Recently, safety valves have been developed employing an electric motor or solenoid for axially shifting a valve head between a closed and an open position relative to the bore of the well conduit. See, for example, U.S. Pat. No. 4,796,708. To apply a lock open mechanism to a safety valve of this construction requires an operable engagement between the shiftable valve head and the lock open mechanism. It is highly desirable that the lock open mechanism be insertable by a wireline operation, hence the only downward force available from a wireline suspended lock open mechanism is that produced by jars incorporated in the wireline. This necessarily means that a sustained downward force cannot be applied to the lock open mechanism to effect the shifting of the valve head of the safety valve from its closed to its open position in a single movement of the jar mechanism.

There is, therefore, a definite need for a wireline operated lock open mechanism which will effect the axial shifting of the valve head of a downhole safety valve in successive increments in response to downwardly produced jarring forces generated by a set of jars in the wireline.

SUMMARY OF THE INVENTION

In accordance with this invention, a tubular lock open tool is run into the bore of the housing containing the closed safety valve by a wireline incorporating jar mechanisms capable of producing both upward and downward jarring forces. Such tool comprises a tubular locking assemblage which is mounted in telescopic relationship to the bottom end of a mandrel and secured to the mandrel for run-in purposes by a transverse shear pin. The tubular locking assemblage has a lower hollow portion having an end wall abuttingly engagable with the valve head of the downhole safety valve. A plurality of radial ports provided in the wall of the hollow portion permit fluid flow into the interior of the tubular locking assemblage and hence into the interior of the well conduit when the lock open operation is completed. The upper end of the tubular locking assemblage includes a collet having a plurality of peripherally spaced, outwardly biased collet heads which, when the shiftable valve head of the safety valve is displaced to its full open position, are engagable with a first downwardly facing locking shoulder provided in the bore of the safety valve housing Since any downward movement of the valve head produced by the mandrel and connected tubular locking assemblage immediately results in an upward force on the mandrel, it is necessary to prevent upward displacement of the mandrel so that the mandrel can be advanced downwardly by successive impacts from the wireline jars. Such unilateral downward movement of the mandrel is accomplished by an intermediate housing assemblage surrounding the upper portions of the mandrel. A body lock ring assemblage is provided between the mandrel and the intermediate tubular assemblage.

It is then necessary to prevent upward movement of the intermediate tubular assemblage and this is accomplished by a collet secured to the top end of the intermediate tubular assemblage and engagable with a second downwardly facing shoulder provided at the top end of the safety valve housing. Such shoulder may, for example, constitute the upper end of a conventional wireline engagable annular recess commonly provided in the upper portion of safety valve housings. Additionally, to position the mandrel and tubular locking assemblage, a second no-go collet is provided on the intermediate locking assemblage which is engagable with an upwardly facing no-go shoulder provided in the safety valve housing.

The connection of the mandrel to the wireline containing the jar mechanism is accomplished by a connection sleeve which is initially shearably secured to the top end of the mandrel, but also has a lost motion connection to the mandrel permitting upward movement of the sleeve for a limited distance without a corresponding movement of the mandrel. The external surface of such sleeve is utilized as a retaining surface to maintain the heads of the latching collet in engagement with the downwardly facing latching shoulder until the successive jar produced downward movements of the mandrel effect the full opening of the shiftable valve member and the engagement of the heads of the locking collet with the downwardly facing locking shoulder. At this point in the travel of the mandrel, a reduced diameter portion of the sleeve moves opposite the heads of the latching collet, permitting such heads to be cammed inwardly and clear the downwardly facing latching shoulder. This clearance permits the retrieval of the mandrel and the intermediate housing assemblage, leaving only the tubular locking assemblage in place in the well. Thus, the shiftable valve head of the safety valve is secured in its full open position.

The foregoing describes the normal operation of the lock open mechanism. If, for any reason, the downward travel of the mandrel stops before the locking heads of the locking collet engage the downwardly facing locking shoulder, the retaining surface on the upper mandrel sleeve will still be positioned adjacent the heads of the latching collet, hence the lock open mechanism cannot be retrieved.

In this condition, the application of upward jarring forces to the mandrel connection sleeve will result in the severing of the shearable connection between the connection sleeve and the top end of the mandrel and permit the sleeve to move upwardly a distance corresponding to that provided by the lost motion connection. This movement is, however, sufficient to remove the restraint imposed by the mandrel sleeve on inward movement of the heads of the latching collet, hence the application of further upward force to the mandrel sleeve will effect the removal of the mandrel and the intermediate housing assemblage from the well.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
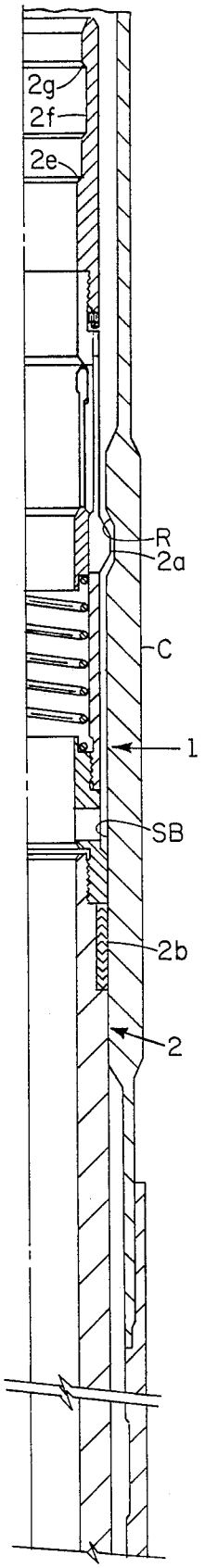
FIGS. 1A and 1B comprise a schematic, vertical quarter sectional view of the upper portions of the safety valve of the type illustrated in the U.S. Pat. No. 4,796,708, with the valve head shown in its closed position.
Figure 1B:
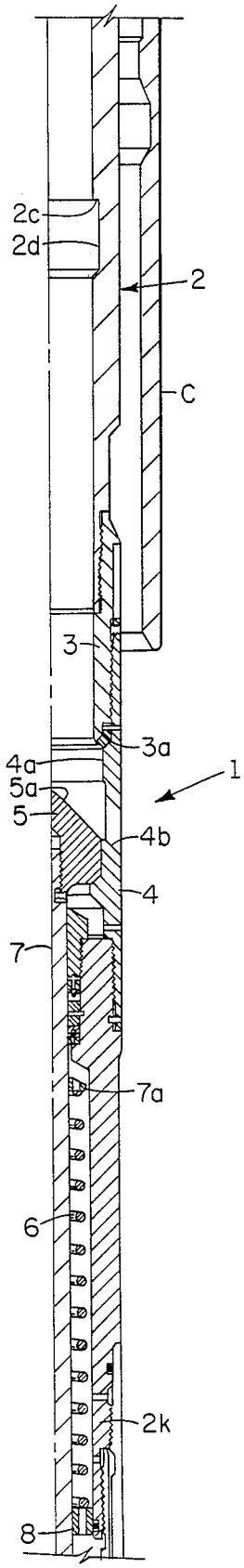

Referring to FIGS. 1A and 1B, there is schematically shown the upper portion of a downhole safety valve 1 for a subterranean well which is of the same general type as described and illustrated in U.S. Pat. No. 4,796,708. Thus this construction will not be described in detail but only the salient components thereof which come into play in the operation of a lock open device embodying this invention will be specifically pointed out.

Such safety valve incorporates a tubular housing assemblage 2 which is secured to the interior of a well conduit C, such as a well casing or production tubing, by engagement of a plurality of peripherally spaced collet heads 2*a* which cooperate with an annular recess R provided in the interior bore of the well casing C. Sealing element 2*b* is mounted on the tubular body assemblage 2 and sealingly cooperates with a cylindrical seal bore portion of the casing C. The lower end of the tubular body assemblage 2 incorporates a tubular seal seat 3 which conventionally mounts an annular seal element 3*a* between its lower perimeter and the upper portion of a valve head sub 4. The valve head sub 4 defines a chamber 4*a* within which a valve head 5 is axially reciprocable. Radial ports 4*b* are provided in the wall of valve head sub 4.

Figure 2A:
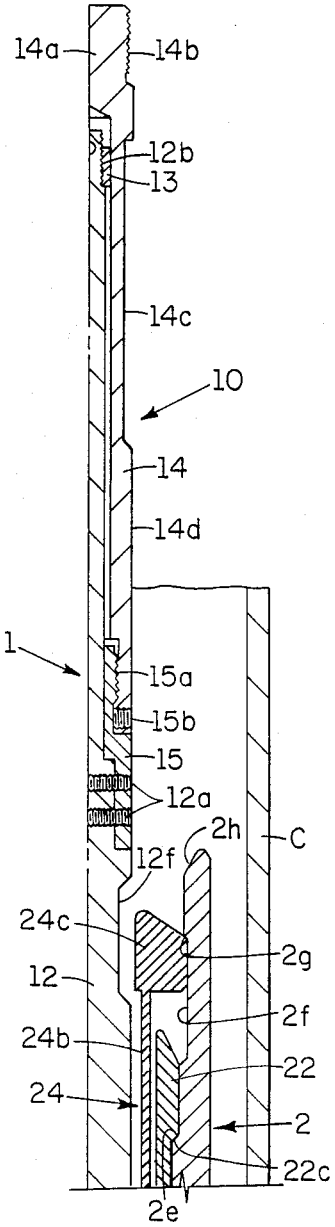
FIGS. 2A, 2B . . . 2D are enlarged scale views similar to FIGS. 1A and 1B but showing the lock open mechanism inserted in the valve housing with the components thereof in their run-in positions.
Figure 2B:
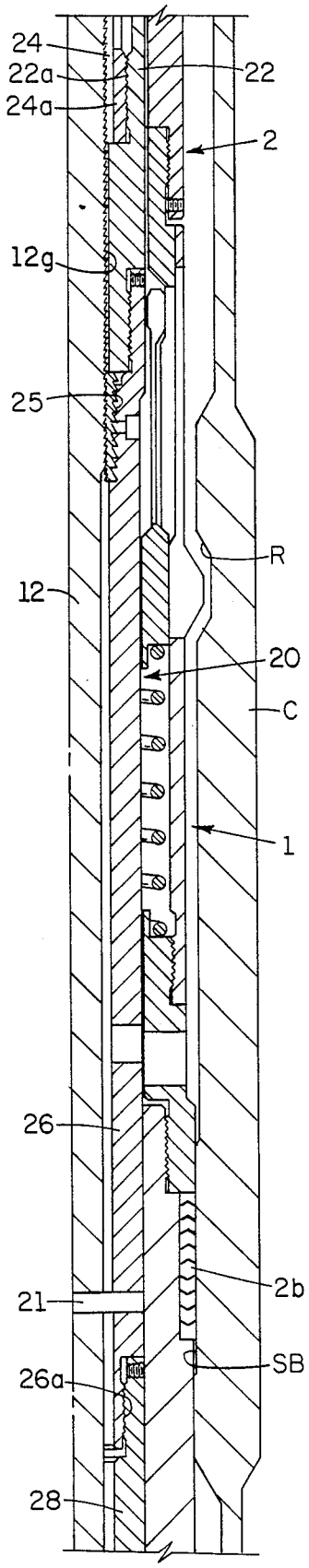
Figure 2C:
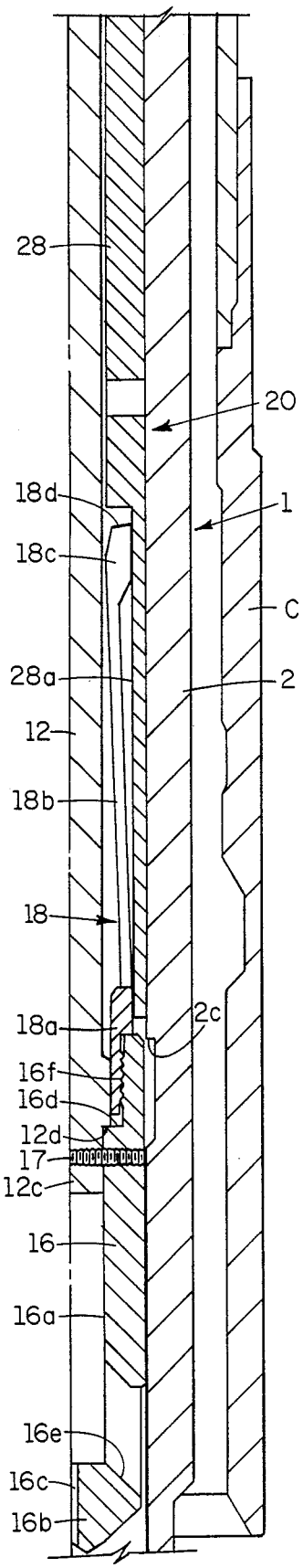
Figure 2D:
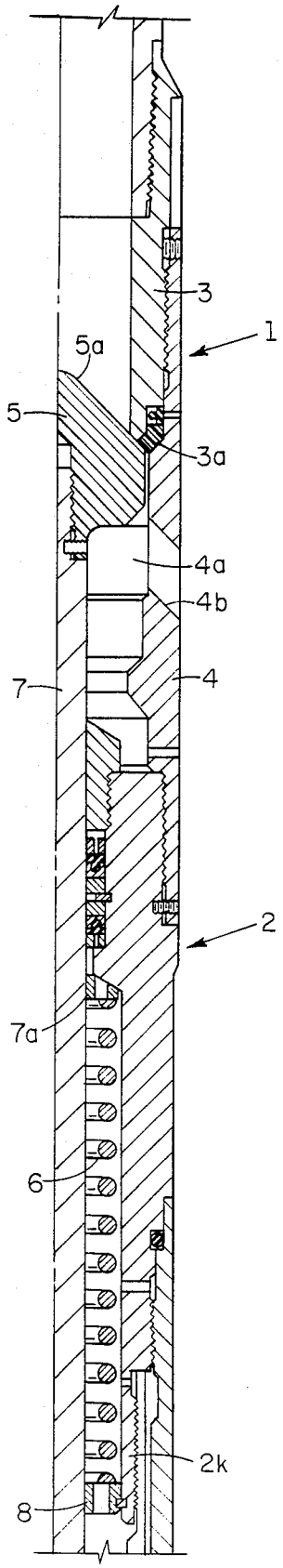
Figure 3D:
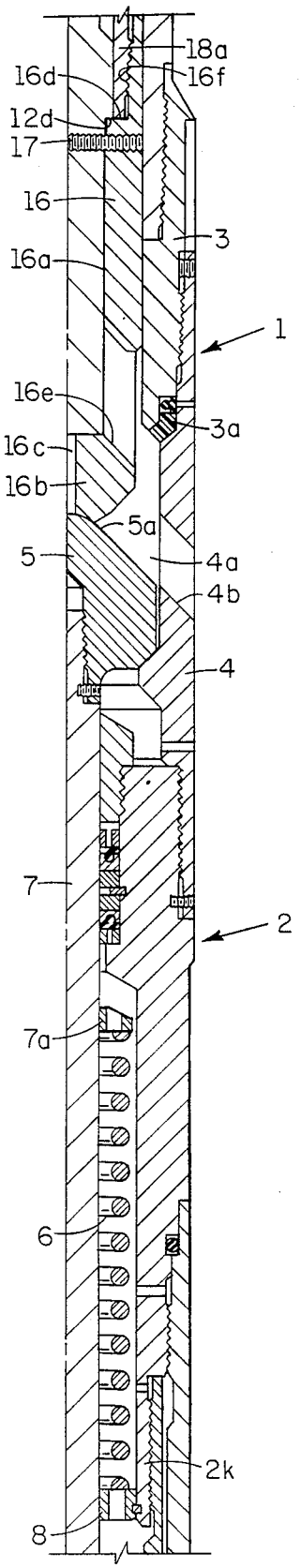

Valve head 5 is mounted on the top end of a rod 7 and has a solid conical surface 5*a* which cooperates at its periphery with the annular seal element 3*a* when the valve head 5 is in its uppermost position as shown in FIG. 2D. Valve head 5 is biased to such uppermost position by a compression spring 6 which abuts a spring anchor 7*a* secured to rod 7 at its upper end and rests upon a spring seat 8 which is conventionally secured to an extension 2*k* of the tubular housing assemblage 2. The axial reciprocation of the valve head 5 is accomplished by an electric motor in the manner described in the aforementioned U.S. Pat. No. 4,796,708 and hence will not be shown or described. The essential point to note is that whenever the valve head 5 is displaced downwardly from its closed sealing position with respect to the annular seal 3*a*, it is constantly urged upwardly to the closed position not only by the spring 6 but also by the pressure of well fluids contained below valve head 5.

In the utilization of a lock open device embodying this invention, the tubular housing assemblage 2 is provided with a first downwardly facing annular shoulder 2*c* located above the seal seat sub 3. It should be noted that this shoulder is defined by an annular recess 2*d* formed in the interior bore surface of the tubular body assemblage 2. At the upper end of the tubular body assemblage 2, an upwardly facing no-go shoulder 2*e* is provided. Above the no-go shoulder 2*e*, the bore of the tubular body assemblage 2 is provided with a recess 2*f* defining a second downwardly facing annular shoulder 2*g*. The first downwardly facing shoulder 2*c*, the no-go shoulder 2*e*, and the second downwardly facing shoulder 2*g* are utilized in the installation and operation of the lock open device embodying this invention.

Referring now to FIGS. 2A, 2B, . . . 302 2D, there is shown a lock open device 10 embodying this invention inserted in the bore of the tubular body assemblage 2, with such lock open assemblage disposed in a run-in position relative to the tubular body assemblage 2 and the valve head 5 of the safety valve.

The lock open assemblage 10 comprises a central mandrel 12 which is secured at its upper end by shear pins 12*a* to the bottom end of a lost motion connecting sleeve 14 through a small sub 15. Connecting sleeve 14 includes a solid top portion 14*a* having external threads 14*b* thereon for conventional assemblage to a wireline which incorporates jars capable of imparting both upward and downward forces. In addition to the shearable connection provided by shear pins 12*a*, the connecting sleeve 14 has a lost motion connection to the mandrel 12 provided by a stop ring 13 which is secured to threads 12*b* formed on the top end of the mandrel 12. The ring 13 is engaged by the top end of the small sub 15 which is secured by threads 15*a* to the bottom end of the lost motion connecting sleeve 14. Such threads are secured by a set screw 15*b*. Thus, if sufficient upward force is applied to the connecting sleeve 14 relative to the mandrel 12, the shear pins 12*a* can be sheared and the connecting sleeve 14 will move upwardly until the small sub 15 contacts the stop ring 13, thereby providing a lost motion connection to the mandrel 12, for a purpose to be hereinafter described.

Mandrel 12 extends through the entire length of the lock open tool 10 and terminates at its lower end in a reduced diameter, cylindrical projection 12*c* (FIG. 2C). Projection 12*c* projects within the bore 16*a* of a tubular lock open head 16. The tubular lock open head 16 has a solid bottom end portion 16*b* traversed by a small central hole 16c but is abuttable with the central portions of the conical surface 5a of the locking head 5 when the mandrel 12 is moved downwardly from its run-in position. A transverse shear pin 17 secures the locking head to the mandrel 12 for run-in purposes. It should be noted that the shear pin 17 is protected from downward impact forces by a downwardly facing annular shoulder 12d formed at the juncture of the depending projection 12c with the main body of the mandrel 12. Shoulder 12d is in abutting engagement with an upwardly facing shoulder 16d formed on the lock open plug 16.

To permit well fluids to pass into the interior of the lock open plug 16 when the valve head 5 is shifted downwardly out of its closed position relative to the annular seal a, the lock open plug 16 is provided with a plurality of peripherally spaced ports 16e. It will be noted that the radial ports 4b provided in the valve head mounting sub 4 will be in communication with the ports 16e when the valve head 5 is displaced downwardly to its open position.

The upper end of the locking plug 16 is provided with internal threads 16f which are threadably engaged by the ring portion 18a of a collet 18. Collet 18 has a plurality of peripherally spaced, upwardly extending, outwardly biased collet arms 18b terminating in enlarged head portions 18c. Head portions 18c have upwardly facing surfaces 18d which are engagable in locking relationship with the first annular downwardly facing locking surface 2c of the tubular body assemblage 2 of the safety valve, as illustrated in FIG. 3C.

Those skilled in the art will recognize that it is not possible to move the mandrel 12 downwardly through the distance required to effect the setting of the collet locking heads 18c beneath the first downwardly facing locking shoulder 2c by a single jarring movement. Thus, it is necessary to provide mechanism to permit the mandrel 12 to move incrementally downwardly with each downward actuation of the wireline jars and prevent upward or reverse movement of the mandrel 12 due to the substantial upward forces exerted on the mandrel 12 by the valve head 5.

The downward incremental movements of mandrel 12 is accomplished by a tubular body assemblage 20 telescopically surrounding the upper portions of mandrel 12. This tubular body assemblage 20 will be hereafter referred to as the intermediate tubular body assemblage since it is disposed intermediate the mandrel 12 and the internal bore of the tubular body assemblage 2 of the safety valve.

Intermediate body assemblage 20 comprises an upper sub 22 (FIG. 2A and 2B) having internal threads 22a mounting the ring portion 24a of a latching collet 24. Latching collet 24 has a plurality of peripherally spaced, outwardly biased spring arms 24b terminating in enlarged latching heads 24c. Latching heads 24c are respectively engagable with the second downwardly facing, inclined locking surface 2g provided on the tubular body assemblage 2 of the safety valve. Additionally, the upper sub 22 of the intermediate body assemblage 20 defines at its upper end an annular no-go shoulder 22c engagable with the upwardly facing no-go shoulder 2e formed on the tubular body assemblage 2. It will therefore be apparent that downward movement of intermediate body assemblage 20 is limited by engagement of no-go shoulders 22c and 2e, positioning the lock open plug 16 upwardly adjacent to the valve head 5 in its closed position (FIG. 2D). Upward movement of the intermediate body assemblage 20 is prevented by the latching collet 24, once the latching heads 24c have snapped into engagement with the second downwardly facing locking shoulder 2g.

To permit the latching heads 24c to thus engage the downwardly facing latching surface 2g, the mandrel 12 is provided near its upper end with an annular groove or depression 12f within which the latching heads 24c are free to be deflected by the upwardly facing tapered surface 2h provided on the extreme top end of the tubular body assemblage 2.

To prevent upward movement of the mandrel 12 after each downward jar advances the mandrel 12 and valve head downwardly, a conventional body lock ring assemblage 25 is provided intermediate the internal bore of the intermediate body assemblage 20 and a ratchet threaded medial portion 12g formed on the mandrel 12. Thus, each downward jar force applied to the mandrel 12 will move the valve head 5 incrementally a short distance, but the mandrel 12 will not retract as the jar mechanism is relaxed to begin the next downward jarring stroke.

To facilitate the insertion of the mandrel 12 and the intermediate body assemblage 20 into the bore of the tubular body assemblage 2, a transverse shear pin 21 (FIG. 2B) is provided which traverses the mandrel 12 and a central tubular body portion 26 of the intermediate body assemblage 20. The central body portion 26 is provided with threads 26a at its lower end to which is secured a spacer sleeve 28 having a depending thin walled portion 28a which secure the lock collet heads 18c in an inwardly retracted position during the run-in operation.

The operation of the aforedescribed lock open mechanism will be readily apparent to those skilled in the art. Once the lock open tool 10 has been inserted in the bore of the tubular body assemblage 2, such insertion movement will proceed until the no-go shoulder 22c engages the upwardly facing no-go shoulder 2e, as shown in FIGS. 2A, 2B, . . . 2D. At this position, the application of a downward jarring force to the connecting sleeve 14 will transmit such force to the mandrel 12 and effect the shearing of the shear pin 21.

Figure 3A:
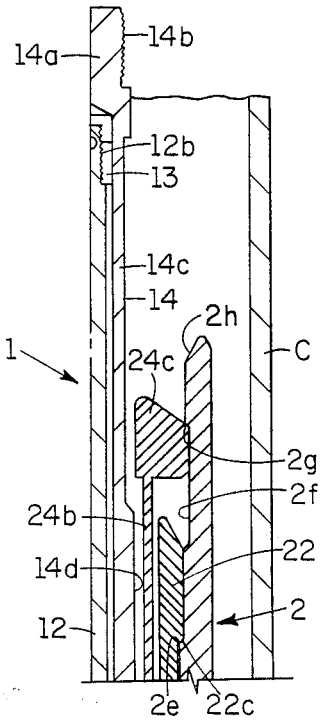
FIGS. 3A, 3B . . . 3D are views respectively similar to FIGS. 2A, 2B . . . 2D but showing the components of the lock open device in their valve opening, locked position.
Figure 3B:
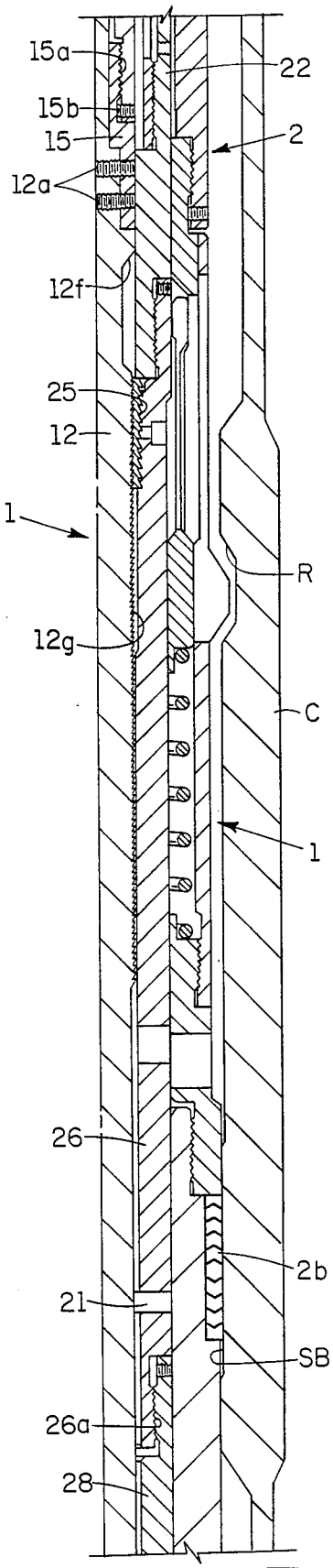
Figure 3C:
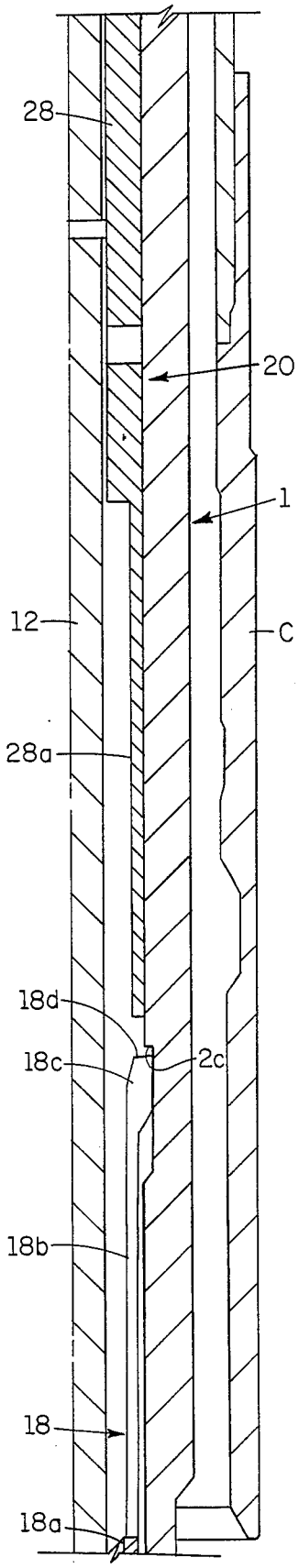

Then, as illustrated in FIGS. 3A, 3B, . . . 3D, further downward jarring forces applied to the connecting sleeve 14 will force the mandrel 12 incrementally downwardly, carrying the locking plug 16 into abutting engagement with the valve head 5 and incrementally moving the valve head 5 downwardly against the bias of its spring 6 and any upwardly directed pressure forces exerted by well fluids. Intermediate the downward jarring forces, upward movement of the mandrel 12 is prevented by the body lock ring assemblage 25 acting on the intermediate body assemblage 20 which is secured against upward movement through the engagement of the latching heads 24c with the second downwardly facing, locking shoulder 2g. The locking heads 24c are held in such engagement by an enlarged diameter surface portion 14d of the connecting sleeve 14. When sufficient downward movement of the valve head 5 has been accomplished to place the valve head in a full open position, the locking heads 18c of the locking collet 18 will snap into the annular recess 2d and lockingly engage the collet 18 against upward movement through abutment of such locking heads with the first downwardly facing locking shoulder 2c. Thus, the valve head 5 is effectively locked in an open position.

The mandrel 12 and intermediate body assemblage 20 may then be removed from the well through the application of upward jars to the mandrel assemblage. Such upward jars effect the severing of the transverse shear pin 17 connecting the mandrel 12 to the locking plug 16, hence permitting the mandrel 12 and the intermediate body assemblage 20 to be moved upwardly out of the tubular body assemblage 2 of the safety valve. Such upward movement is not prevented by the latching heads 24c of the latching collet 24 because in the extreme downward position of the mandrel 12 corresponding to the full open position of the valve head 5, a reduced diameter section 14c formed on the mandrel connection sleeve 14 is disposed opposite the latching heads 24c, permitting such latching heads to be cammed outwardly by the downwardly facing, inclined second locking shoulder 2g.

Figure 4:
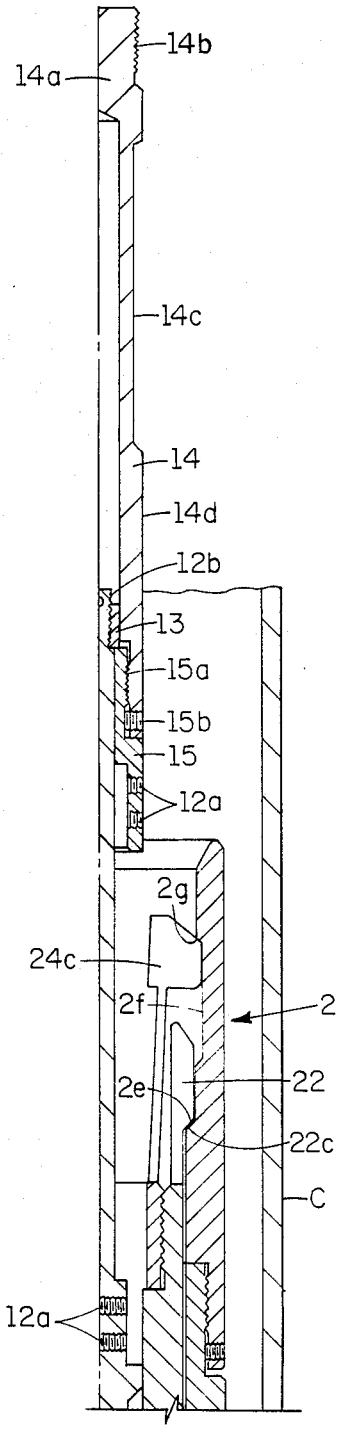
FIG. 4 is a view similar to FIG. 3A but illustrating the operation of the mandrel connecting sleeve to effect the release of the lock open mechanism under an emergency condition.

It will be noted that in the foregoing description of a normal operation of the lock open mechanism, no mention has been made of the lost motion connection between the connecting sleeve 14 and the top end of the mandrel 12. This lost motion connection is provided to permit the retrieval of the lock open assemblage in the event that, for whatever reason, the mandrel 12 is not able to move the locking plug 16 downwardly enough to permit the locking heads 18c of the locking collet 18 to engage the first downwardly facing annular locking shoulder 2c. If this condition occurs, the lock open mechanism cannot be retracted because the enlarged diameter surface 14d of the connecting sleeve 14 will be disposed internally adjacent the latching heads 24b, preventing such latching heads from releasing from the second downwardly facing shoulder 2g. This emergency problem is overcome through the application of still stronger upward jarring forces sufficient to effect the severing of the shear screws 12a, thus permitting the connecting sleeve 14 to move upwardly relative to the mandrel 12 to the position illustrated in FIG. 4. In this position, all inward restraint on the movement of the latching heads 24c is removed and such heads are free to deflect inwardly and clear the second downwardly facing latching shoulder 2g. After sufficient movement of the connecting sub 14 to provide this clearance, the previously described lost motion connection between the connecting sleeve 14 and the mandrel 12 will take over and the mandrel 12 will be pulled upwardly through the engagement of the top end of the small sub 15 with the ring 13 that is threadably secured to the top end of the mandrel 12.

It will therefore be apparent to those skilled in the art that the aforedescribed method and apparatus provides a completely reliable system for effecting the locking open of a downhole valve wherein the valve incorporates a valve head which is axially downwardly movable between a closed position to an open position with respect to the bore of the conduit in which it is mounted. After the locking is achieved, it is further assured that the entire lock open mechanism, with the exception of the locking collet, can be expeditiously removed from the well.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. For use in a downhole safety valve for a subterranean well conduit having an axially shiftable valve member movable downwardly between a closed and an open position relative to the conduit bore and biased to said closed position; said safety valve including a tubular housing assemblage defining an upwardly facing no-go shoulder in its upper end and a downwardly facing locking shoulder in its lower end above said valve member;

a wireline operable lock open mechanism comprising:

a central mandrel having means on its upper end for connection to a wireline equipped with jars;

a tubular locking assemblage shearably secured to the bottom end of said central mandrel and abuttingly engagable with said valve member;

an intermediate tubular housing assemblage surrounding the upper portions of said mandrel and insertable in the bore of said valve housing assemblage with said mandrel;

shearable means connecting said mandrel assemblage to said intermediate housing assemblage for run-in;

downwardly facing no-go shoulder means on the upper end of said intermediate housing assemblage;

said downwardly facing no-go shoulder means being body lock means engagable with said upwardly facing no-go shoulder to position said tubular locking assembly upwardly adjacent to said valve member;

intermediate housing assemblage and said mandrel assemblage to permit only downward jar produced movement of said mandrel assemblage relative to said intermediate housing assemblage after shearing said shearable means, thereby moving said tubular locking assemblage and said valve member incrementally downwardly to said open position; and lock means on said locking assemblage engagable with said downwardly facing locking shoulder, thereby securing said valve member in an open position and permitting an upward force on said mandrel to shearably detach said mandrel from said tubular locking assemblage.

2. The apparatus of claim 1 wherein said tubular locking assemblage comprises a hollow cylindrical body having a bottom end surface engagable with said valve member and a radial port in the side wall of said hollow cylindrical body permitting fluid flow into the conduit bore.

3. The apparatus of claim 2 wherein said lock means comprises a lock open collet having a ring portion and peripherally spaced locking arms respectively mounting latching heads; and means for shearably securing said lock open collet ring portion to the upper end of said hollow cylindrical body.

4. The apparatus of claim 2 wherein the shearable securement of said tubular locking assemblage to the bottom end of said mandrel comprises a shear pin traversing the side wall of said hollow cylindrical body and the bottom end of said mandrel.

5. The apparatus of claim 3 wherein said collet locking heads on said tubular locking assemblage engage said downwardly facing locking shoulder only when said valve member is shifted downwardly to its said open position.

6. For use in a downhole safety valve for a subterranean well conduit having an axially shiftable valve member movable downwardly between a closed and an open position relative to the conduit bore, and spring biased to said closed position;

said safety valve including a tubular housing assemblage including an upwardly facing no-go shoulder in its upper end, a downwardly facing valve locking shoulder in its lower end above said valve member, and a downwardly facing latching shoulder in its upper end above said no-go shoulder and having a greater internal diameter than said no-go shoulder;

a wireline operable lock open mechanism comprising:

a central mandrel having means on its upper end for connection to a wireline equipped with jars;

a tubular locking assemblage shearably secured to the bottom end of said central mandrel and abuttingly engagable with said valve member;

an intermediate tubular housing assemblage surrounding the upper portions of said mandrel and insertable in the bore of said valve housing assemblage with said mandrel;

shearable means connecting said mandrel assemblage to said intermediate housing assemblage for run-in;

a downwardly facing no-go shoulder on said intermediate tubular housing assemblage engagable with said upwardly facing no-go shoulder to position said tubular locking assembly upwardly adjacent to said valve member;

a latching collet secured to said intermediate housing assemblage;

said latching collet having outwardly biased head portions engagable with said downwardly facing latching shoulder when said no-go shoulder are in engagement, thereby absorbing any upward forces on said intermediate housing assemblage;

body lock ring means operatively interconnecting said intermediate housing assemblage and said central mandrel to permit only downward, jar produced movement of said central mandrel relative to said intermediate tubular housing assemblage after shearing said shearable means, thereby moving said tubular locking assemblage and said valve member incrementally downwardly to said open position; and lock means on said locking assemblage engagable with said downwardly facing locking shoulder, thereby securing said valve member in an open position and permitting an upward force on said mandrel to shearably detach said mandrel from said tubular locking assemblage.

7. The apparatus of claim 6 wherein said tubular locking assemblage comprises a hollow cylindrical body having a bottom end surface engagable with said valve member and a radial port in the side wall of said hollow cylindrical body permitting fluid flow into the conduit bore.

8. The apparatus of claim 7 wherein said lock means comprises a lock open collet having a ring portion and peripherally spaced locking arms respectively mounting latching heads; and means for shearably securing said lock open collet ring portion to the upper end of said hollow cylindrical body.

9. The apparatus of claim 6 further comprising an annular notch on said central mandrel alignable with said latching collet head portions during run-in, thereby permitting said latching collet heads to clear said downwardly facing latching shoulder.

10. The apparatus of claim 9 further comprising a sleeve surrounding said central mandrel;

said sleeve defining an upwardly extending surface above said annular notch positioned adjacent said latching collet heads to prevent release of said collet latching heads during the incremental downward motion of said central mandrel.

11. The apparatus of claim 10 further comprising a reduced diameter portion of said sleeve alignable with said latching collet heads when said central mandrel reaches the valve open position and engages said lock means with said downwardly facing locking shoulder, thereby permitting removal of said mandrel and said intermediate tubular housing assemblage from the tubular housing assemblage.

12. The apparatus of claim 10 further comprising shear means securing said sleeve to said central mandrel and a lost motion connection between said sleeve and said central mandrel to permit upward movement of said sleeve to clear said latching collet heads by upward movement of said sleeve by the wireline.

13. The apparatus of claim 10 wherein the upper end of said sleeve mounts said wireline connection means;

shearable means connecting said sleeve to said central mandrel in a normal position; and lost motion means permitting limited upward movement of said sleeve relative to said mandrel to clear said latching collet heads for releasing movement from said downwardly facing latching shoulder in the event of an emergency preventing full downward movement of said central mandrel to lock open said valve member.

14. The apparatus of claim 3 or 8 wherein said intermediate tubular housing assemblage includes a sleeve surrounding said lock open collet locking heads during run-in; and said collet locking heads being moved downwardly out of said sleeve by said incremental downward movement of said mandrel produced by said jarring forces.

15. The method of locking open a downhole safety valve having a tubular body serially inserted in a well conduit, a valve head axially movably mounted in the tubular body between an upper closed position relative to the bore of the tubular body and a lower open position permitting fluid flow through the bore of the tubular body, and resilient means biasing said valve head upwardly to said closed position, comprising the steps of:

(1) providing in the bore of the tubular body: a downwardly facing locking shoulder upwardly adjacent to the valve head, an upwardly facing internal no-go surface adjacent the upper end of the tubular body, and a downwardly facing latching shoulder;

(2) shearably mounting a locking assemblage on the bottom end of a mandrel, said locking assemblage including a ported hollow plug engagable with said valve head and a locking collet, the locking heads of the collet being engagable with said downwardly facing locking shoulder;

(3) shearably mounting a tubular intermediate housing assemblage on the upper portions of said mandrel, said tubular intermediate housing assemblage defining an external no-go shoulder engagable with said no-go shoulder, and a latching collet having latching heads engagable with said downwardly facing latching shoulder;

(4) providing a body lock ring connection between said tubular intermediate housing and said mandrel permitting only downward movement of said mandrel relative to said tubular intermediate housing;

(5) inserting said mandrel, said locking collet, and said tubular intermediate housing assemblage in the well and into the bore of said tubular body by a wireline equipped with jars until said no-go shoulders engage and said latching collet heads engage said downwardly facing latching shoulder;

(6) applying downward jarring forces to said mandrel to (a) shearably release the mandrel from said tubular intermediate housing, (b) move a retaining surface inwardly adjacent said latching heads of said latching collet to secure said latching heads in engagement with said downwardly facing latching shoulder, (c) force said valve head incrementally downwardly to said open position where said locking collet heads engage said downwardly facing locking shoulder, and (d) remove said restraining surface from said latching heads of said latching collet;

(7) applying upward jarring forces to said mandrel to shearably release said mandrel from said locking assemblage; and (8) retrieving said mandrel and said tubular intermediate housing from the well.

* * * * *